United States Patent [19]

Heywood et al.

[11] 4,426,082

[45] Jan. 17, 1984

[54] IMPROVEMENTS TO POKER MACHINES-SIMULATED HANDLE ACTION

[76] Inventors: Joseph R. Heywood, 2 Beechwood Ave., Chorleywood, Herts, England, WD3 5RL; Leonard H. Ainsworth, 108 Dunning Ave., Roseberry, NSW, Australia

[21] Appl. No.: 160,818

[22] Filed: Jun. 18, 1980

[30] Foreign Application Priority Data

Jun. 25, 1979 [AU] Australia ..... PD9313

[51] Int. Cl.[3] ..... A63F 5/04

[52] U.S. Cl. ..... 273/143 R; 194/DIG. 12; 273/138 A

[58] Field of Search ..... 273/143 R, 143 A, 143 B, 273/143 C, 143 D, 143 E, 138 A; 194/DIG. 11, DIG. 12; 200/153 G, 153 H, 156, 335; 74/118, 119, 125.5, 141.5, 142, 143, 497, 568 T, 577 S, 577 R, 577 M, 578

[56] References Cited

U.S. PATENT DOCUMENTS 3,151,500 10/1964 Kurz ..... 74/568 UX
4,058,026 11/1977 Simpson ..... 119/DIG. 11 X
4,236,717 12/1980 Wichinsky ..... 273/143 R

FOREIGN PATENT DOCUMENTS 1238486 7/1971 Australia ..... 273/143 R
564650 10/1923 France ..... 200/156

*Primary Examiner*—Robert A. Hafer
*Assistant Examiner*—Arnold W. Kramer
*Attorney, Agent, or Firm*—Holman & Stern

[57] ABSTRACT

Device to simulate the action of a conventional mechanical poker machine in an electrically operated poker machine in which the game cycle is initiated by the operation of an electric switch comprising a handle similar to that of a conventional machine connected to a friction device within the cabinet consisting of a spring loaded friction clutch arranged so that as the handle is pulled its movement will be resisted as in a conventional machine, the frictional resistance being automatically removed after the handle has travelled through a predetermined arc. The elements of the friction clutch are provided with ramps such that as the handle is pulled the frictional resistance progressively increases until at the end of the predetermined arc the ramps on the friction elements of the clutch reach their peaks and fall off into the next ramp immediately reducing the frictional load and an electric switch is actuated to start the machine.

3 Claims, 2 Drawing Figures

IMPROVEMENTS TO POKER MACHINES-SIMULATED HANDLE ACTION

FIELD OF THE INVENTION

This invention relates to poker machines of the type which are electrically operated and provides a mechanism to simulate the force of the handle of a mechanically operated machine.

DESCRIPTION OF THE PRIOR ART

Until recently all poker machines (also known as fruit machines or slot machines) manufactured and marketed around the world were of what is called "the mechanical type". This means that the internal mechanism of such machines was actuated by mechanical means and performed its various functions by a series of mechanical devices. Nearly all such machines were operated by the insertion of a coin which then permitted the player to pull a handle, usually situated on the right hand side of the machine's cabinet. As the operation of these machines was solely mechanical the action of pulling the handle involved some force because it had to overcome various spring pressures which provided the stored energy to supply the mechanism with the necessary power to perform its functions.

Of recent years electronics have been introduced in varying degrees to assist or in many cases replace the mechanical arrangements of the past. In most cases an electric motor is used to drive the mechanism through its complete game cycle. This has meant that the action of pulling the handle to activate the mechanism is no longer essential as it is now only necessary to operate an electric switch. This switch activates various electronic circuits which in turn activate the electric motor drive system.

BRIEF SUMMARY OF THE INVENTION

In order to maintain the traditional format of such poker machines a handle is still fitted to the machine's cabinet but as the action of pulling the handle nowadays only operates a switch it requires no noticeable force to operate it. The absence of any noticeable resistance to movement of the handle when pulled is considered to be undesirable because the player has always in the past regarded the action of pulling the handle and the force needed to operate it as an intrinsic part of playing the machine. The deletion of the handle together in favour of some other means of operation of the start switch is also considered undesirable for the same reasons. This invention is intended to simulate the forces previously experienced when pullng the machine's handle without such forces actually performing any useful function.

As the force necessary to simulate effectively the old mechanical type of machine is of quite large porportions it is necessary to create a means of developing a load and dissipating it without placing too much strain on the machine cabinet structure.

The present invention consists in an electrically operated poker machine in which the game cycle is initiated by the operation of an electric switch, having a mechanism simulating the operation of the handle of a conventional mechanical poker machine, the mechanism consisting of a substantially conventional handle operable by a player and pivotably mounted on the cabinet of the machine, friction means within the cabinet arranged to resist movement of said handle, means to remove said resistance on the handle having moved through a predetermined arc and means to operate said electric switch after said resistance is removed.

BRIEF DESCRIPTION OF THE DRAWINGS

In order that the nature of the invention may be better understood a preferred form thereof is hereinafter described by way of example, with reference to the accompanying drawings in which.

DETAILED DESCRIPTION

Figure 1:
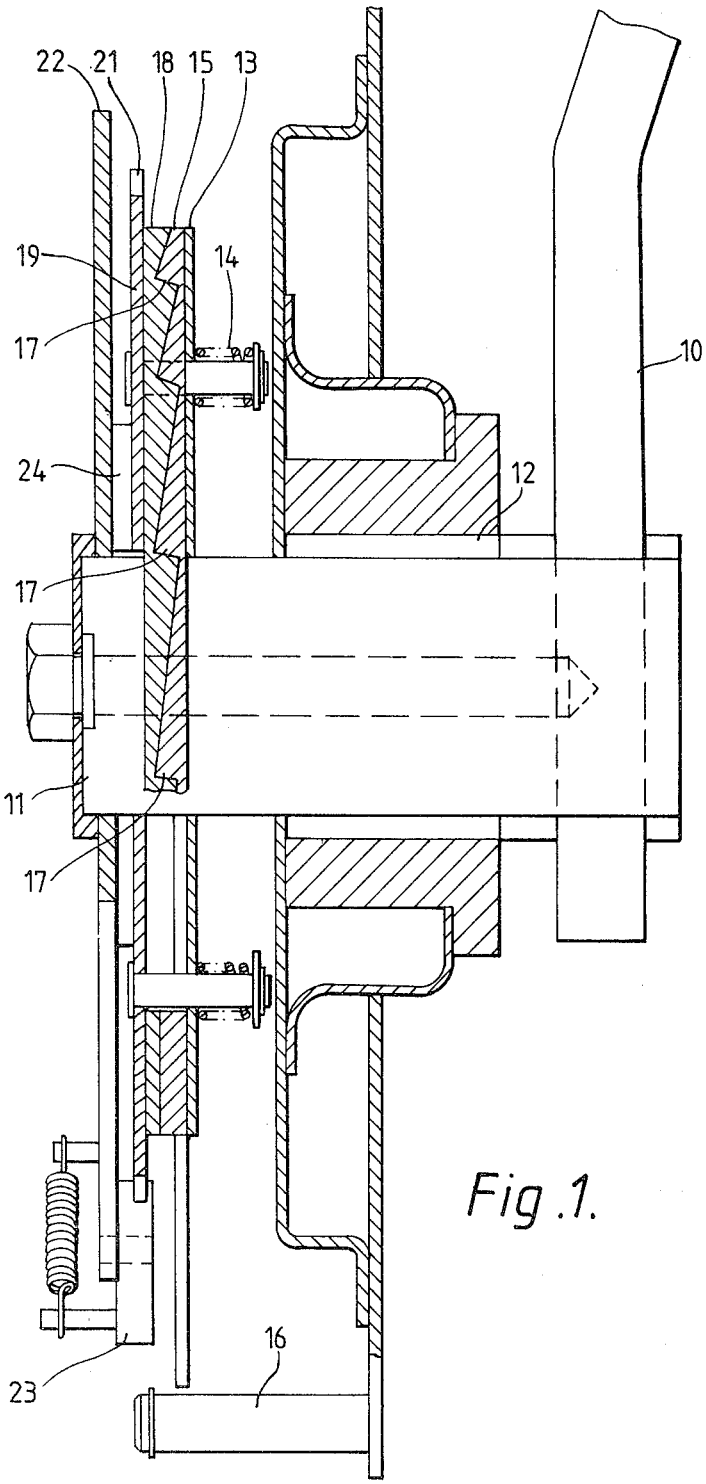
FIG. 1 is a side elevational view of a mechanism according to the invention, partly in cross-section.

A conventional type of handle 10 is fitted to a spindle 11 pivotally mounted in a bushing 12 on the side of the cabinet of a poker machine. Located on the inside of the cabinet and mounted concentric with the handle spindle is a friction clutch arrangement. This consists of a pressure plate 13 which exerts pressure by means of a number of compression springs 14 on an annular friction plate 15 which is anchored by being located on a pin 16 attached to the inside of one side of the cabinet. The annular friction plate 15 has a series of circumferentially extending tapered ramps 17 formed on its inner face. Mounted adjacent to this central plate and in contact with it is an annular plate 18 made of friction material with also has a series of circumferentially extending tapered ramps on its inner face (see FIG. 1) which mate with the similar ramps 17 on the central friction plate 15. This is held in contact by a further steel plate 19, around the periphery of which is a series of ratchet teeth 21. The whole of this assembly apart from the plate 15 is freely floating about the handle spindle 11.

Attached to the inside end of the handle spindle 11 is a plate 22 (see FIGS. 1 and 2) upon which is mounted a small pawl 23 (FIG. 2) spring loaded in such a way that the point engages with the ratchet teeth 21 of the plate 19.

Figure 2:
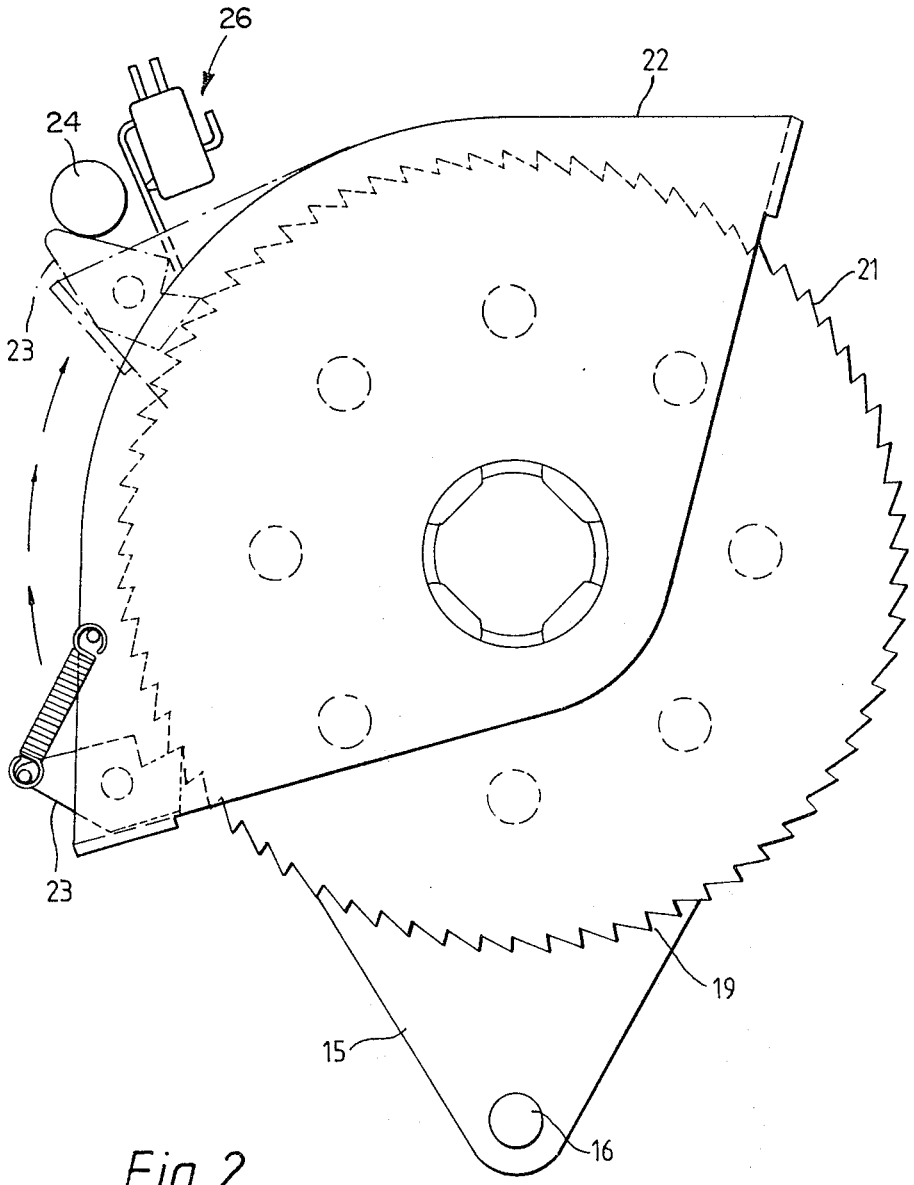
FIG. 2 is an end view in elevation of the mechanism taken from the left side of FIG. 1.

As the handle 10 is pulled in the direction indicated by the arrows in FIG. 2 the plate 22 rotates the plate 19 in the same direction and this in turn rotates the pressure plate 13. Because the friction plate 15 is anchored and cannot move, the movement of the outer plates 13 and 19 is resisted by the friction created by the spring pressure on the plate 18 made of friction material which is attached to and rotates with the outer plate 19. As this friction plate 18 rotates the ramps on its inner face climb up the ramps on the fixed annular plate 15. This action coupled with the resistance caused by the friction material causes an increasing frictional load until the ramps on the two plates 15 and 18 reach their peaks and fall off into the next ramp which immediately reduces the frictional load.

The load so created by this friction can be adjusted by varying the strength of the pressure springs 14.

When the handle 10 has traversed the correct arc of movement the tail of the pawl 23 comes into contact with a fixed stop 24 (as indicated in broken lines in FIG. 2) and further movement of the handle 10 causes the pawl 23 to disengage from the ratchet teeth 21 on the plate 19 thereby disengaging the handle 10 from the friction load of the clutch. The action of the ramps on the moving friction plate 18 climbing the mating ramps 17 on the fixed plate 15 and then falling off them creates a gradually increasing load followed by a sudden marked removal of load thus giving the player a feeling similar to that experienced with a mechanical type of poker machine.

The action of the pawl disengaging also operates a switch generally shown at 26 which starts the machine mechanism which will then complete its game cycle.

The handle is then free to return to its starting position under the influence of a suitable spring (not shown) ready to commence the operation again.

In its "at rest" position a solenoid operated latch (not shown) is so arranged to prevent movement of the handle until the insertion of a coin into the machine releases it.

Thus it will be seen that this friction clutch arrangement creates a load which has to be overcome when pulling the handle until the switch is operated and the machine starts. This simulation gives a player the impression of doing something and a feeling of participation in the game that would otherwise be lacking if he only operated a switch.

We claim:

1. In an electrically operated poker machine mounted in a cabinet wherein the game cycle is initiated by the operation of an electric switch, a mechanism simulating the operation of a handle of a conventional mechanical poker machine comprising, a substantially conventional handle operable by a player and pivotably mounted on the cabinet, a friction clutch within the cabinet for increasingly resisting movement of the handle as it is moved through a predetermined actuating arc comprising an annular element fixed in relation to said cabinet and a movable annular element engaging said fixed element and arranged to move as said handle is moved, spring means resiliently retaining the engaging surfaces of said elements in contact with each other, a series of circumferentially extending interengaging ramps on the engaging surfaces of said elements arranged so that rotational movement of said movable element causes the ramps on its surface to ride up the ramps on the surface of said fixed element thereby increasing frictional resistance to movement of said handle, the length of said ramps being such that ramps of the movable element reach the ends of ramps on said fixed element after the handle has moved through said predetermined actuating arc thereby suddenly decreasing said resistance, and means to operate said electric switch at the end of said actuating arc.

2. An electrically operated poker machine in which the game cycle is initiated by the operation of an electric switch, having a mechanism simulating the operation of the handle of a conventional mechanical poker machine, the mechanism comprising a substantially conventional handle operable by a player and pivotably mounted on the cabinet of the machine, a friction clutch within the cabinet comprising an element fixed in relation to said cabinet and a movable element arranged to move as said handle is moved, spring means resiliently retaining said elements in contact with each other, said elements cooperating to increasingly resist movement of said handle as it is moved through predetermined arc, means to abruptly reduce said resistance after said handle has moved through said predetermined arc, a ratchet wheel arranged to move with said movable element, a pawl arranged to be movable with said handle and operatively engaging said ratchet wheel, means arranged to disengage said pawl from said ratchet wheel after said handle has moved through said predetermined arc, the disengagement of said pawl from said ratchet wheel activating the operation of said electric switch.

3. An electrically operated poker machine as claimed in claim 2 wherein said elements comprise annular members having on their engaging surfaces a series of circumferentially extending interengaging ramps arranged so that rotational movement of the moveable element causes the ramps on it to ride up the ramps on the fixed element thereby increasing the pressure exerted by said spring means and thereby increasing frictional resistance to movement of said handle, and said means to abrubtly reduce said resistance comprises the length of said ramps being such that the ramps on the moveable element reach the ends of ramps on the fixed element at the end of said predetermined arc.

* * * * *